United States Patent [19]

Driscoll et al.

[11] 4,325,230

[45] Apr. 20, 1982

[54] PLASTIC ICE CUBE

[76] Inventors: Mark Driscoll, c/o George Spector, 3615 Woolworth Bldg., 233 Broadway; George Spector, 3615 Woolworth Bldg., 233 Broadway, both of New York, N.Y. 10007

[21] Appl. No.: 146,467

[22] Filed: May 5, 1980

[51] Int. Cl.[3] ..... F25D 3/00; F25D 3/08

[52] U.S. Cl. ..... 62/293; 62/530

[58] Field of Search ..... 249/53 R, 203; 62/330, 62/340, 372, 530, 293, 457; D15/80, 90

[56] References Cited

U.S. PATENT DOCUMENTS 740,847 10/1903 Glebsattel ..... 62/530

1,641,139 8/1927 Glennan ..... 62/530

1,923,522 8/1933 Whitehouse ..... 62/530

1,944,726 1/1934 Aiken ..... 62/293

FOREIGN PATENT DOCUMENTS 1365346 5/1964 France ..... 62/293

*Primary Examiner*—Lloyd L. King

[57] ABSTRACT

An ice cube for use in beverages and which will not melt, so that it will not dilute the beverage, the ice cube being molded of transparent plastic so to resemble ice, and which can be frozen in a refrigerator freezer prior to use; and the ice cube in one design carrying an identifying numeral, which becomes less visible when the beverage and cube get less cold.

4 Claims, 7 Drawing Figures

15
10

15
10
3
3
3

14
12
11
13
12

10
16
14
12

17

18

19
20
21

23
24
22
26
25
27
27
25

PLASTIC ICE CUBE

This invention relates generally to beverage—cooling ice cubes.

It is well known that many beverages are preferable to drink when cold. Accordingly persons usually place some ice cube therein for cooling the same. However, this has some disadvantages in view that as the beverage is cooled the ice cube disolves, and the beverage thus becomes diluted and is less tasty. This is particularly undesirable in certain drinks and also in milk.

Therefore it is a principal object of the present invention to provide an ice cube which cannot melt, so that it will not dilute the beverage.

Another object is to provide an ice cube which in one design automatically indicates to a drinker when the ice cube is no longer cooling his beverage, so should be replaced.

Yet another object is to provide an ice cube which may be made in any desired shape.

Yet a further object is to provide another design of ice cube which is a hollow plastic shell inside which a conventional ice cube, made of frozen water, can be placed.

Figures 1, 2, 3, 3A, 4, 5, 6, 7:
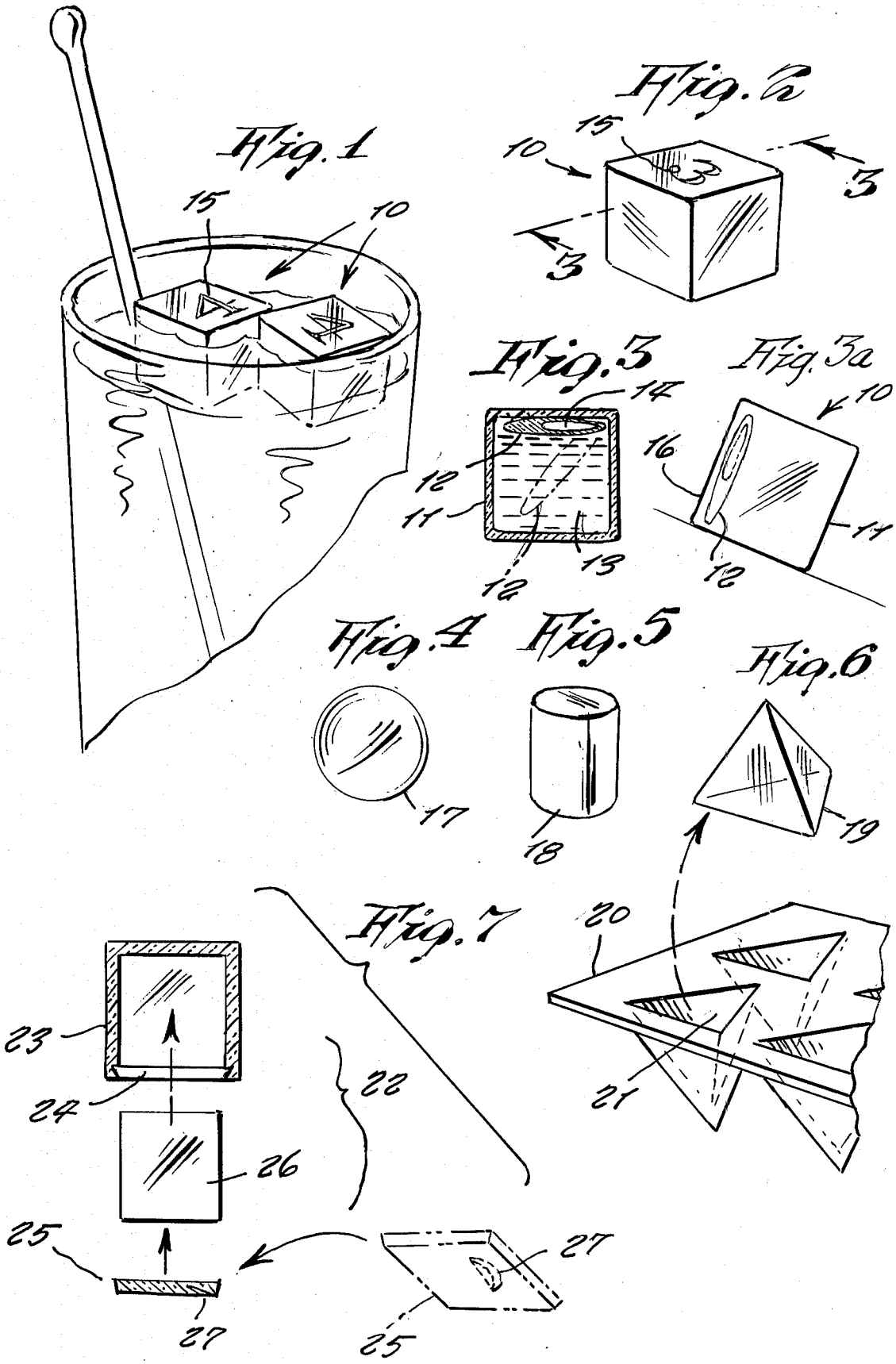
FIG. 1 is a perspective view of a beverage in a glass being cooled by one design of a pair of plastic ice cubes which are numbered so as to identify who's drink the glass contains, such as when used at a party where glasses put down, can become mixed up.
FIG. 2 is a perspective view of one of the ice cubes of FIG. 1, with a transparent disc inside with the number being printed on it, so that only the number is visible, while the disc cannot be seen.

FIG. 3 is a cross sectional view on line 3—3 of FIG. 2 showing the cube being made of a thin plastic shell sealed with water so that it can be frozen and also containing the printed disc, the disc being hollow so to always float at a top in order that the number is visible when a person looks down in the glass at the floating ice cube, the cube being weighed at one end so that a person can tell if his drink is no longer being cooled, due to the weighed end starting to droppin the melting water of the ice cube, as shown by the dotted lines; FIG. 3*a* showing the disc position in the water when the cube is placed in a freezer for freezing.

FIGS. 4,5 and 6 show other different possible shapes of plastic ice cubes frozen in a freezer ice cube tray.

FIG. 7 is a cross section of another design of plastic ice cube can be opened so to place a frozen ice inside, by having a removable bottom cap that snaps on and includes a notch on a bottom for a finger nail to pull it off, when needed.

Referring now to the drawing in greater detail, and more particularly to FIGS. 1 through 3*a*, there is shown an ice cube 10 that is molded of a transparent plastic material so as to resemble an appearance of a convention ice cube. It comprises a hollow shell 11 inside of which there is sealed a circular, flat disc 12 and a remainder of the interior is filled with water 13. The disc is also molded of a transparent plastic and is molded with a hollow chamber 14 toward one end thereof and which is filled with air. A numeral 15 or other identifying mark is printed on one side of the disc, so as to aid a drinker at a party in identifying his glass of beverage if he puts it down on a table along with the glasses of others drinkers.

The numeral 15 also serves to inform the drinker when his beverage is no longer being adequately cooled, by means of the numeral becoming less visible, caused by the disc falling down inside the shell 11 as the water 12 starts to melt so that it no longer supports the disc on its top. The end of the disc farthest from the air chamber 14 drops downwardly first so to tilt the disc as shown by phantom lines in FIG. 3, and the tilted numeral is then seen only on its edge when looking down into the beverage glass. The unweighed end of the disc having the air chamber tends to float so remains upward.

The ice cube 10 must accordingly be placed in a freezer in a position so that the disc is frozen at a top of the water. This is accomplished by positioning the ice cube in a tilted position as shown in FIG. 3*a* so that the disc rests against one side wall 16 of the shell until the water freezes.

In use, the disc edges are not visible due to the transparent plastic material in the water, so a viewer sees only the numeral of the disc.

FIGS. 4,5 and 6 illustrate that plastic ice cube may be molded in any of various different shapes, such as a sphere 17, cylinder 18 or triangular 19. These may be placed in a refrigerator freezer ice tray 20 having correspondingly shaped ice cube compartments 21.

In FIG. 7, another design of ice cube 22 is shown that comprises a transparent plastic hollow shell 23 which has an opening 24 on one side that is closable by a snap-on cover 25 of similar material, so as to permit placement thereof of a conventional ice cube 26, made of frozen water. Thus when the ice cube 26 melts, it will not dilute the beverage. A notch 27 on the cover permits a person's finger nail to pry the cover off the shell when wished for refilling with a fresh ice cube.

What is claimed as new, is:

1. A freezable object for cooling a beverage, comprising in combination, a hollow shell of transparent plastic material, an identifying disc therein and a quantity of water filling an interior of said shell, wherein said disc comprises a flat member made of transparent plastic material with an identifying character printed thereon, said disc being located between said shell and water when frozen.

2. An object as in claim 1 including means for indicating the water is no longer frozen.

3. An object as in claim 2 wherein said means comprise said disc being lighter than water at one portion thereof, causing said portion to float and the remainder to sink when ice is melted.

4. An ice cube as in claim 3 wherein said disc has an off center air space.

* * * * *